US007993181B2

(12) United States Patent
Lee et al.

(10) Patent No.: US 7,993,181 B2
(45) Date of Patent: Aug. 9, 2011

(54) ARTIFICIAL EYE

(75) Inventors: Chun-Yu Lee, Taipei Hsien (TW); Tsung-Yu Lin, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 120 days.

(21) Appl. No.: 12/399,208

(22) Filed: Mar. 6, 2009

(65) Prior Publication Data

US 2010/0010626 A1 Jan. 14, 2010

(30) Foreign Application Priority Data

Jul. 8, 2008 (CN) ..... 2008 1 0302642

(51) Int. Cl.
*A63H 3/38* (2006.01)

(52) U.S. Cl. ..... 446/392

(58) Field of Classification Search ..... 446/341, 446/392

See application file for complete search history.

(56) References Cited

U.S. PATENT DOCUMENTS

| | | | | |
|---|---|---|---|---|
| 1,832,743 | A * | 11/1931 | Shuldiner | 446/392 |
| 2,792,573 | A * | 5/1957 | Clarke et al. | 623/6.64 |
| 6,545,384 | B1 * | 4/2003 | Pelrine et al. | 310/309 |
| 6,586,859 | B2 * | 7/2003 | Kornbluh et al. | 310/309 |
| 2004/0106353 | A1 * | 6/2004 | Chang | 446/392 |
| 2009/0197504 | A1 * | 8/2009 | Hsu | 446/301 |

* cited by examiner

*Primary Examiner* — Gene Kim
*Assistant Examiner* — Alyssa Hylinski
(74) *Attorney, Agent, or Firm* — Clifford O. Chi

(57) ABSTRACT

An artificial eye includes a supporter, a first clipping member, a second clipping member and an electroactive pupil. The second clipping member is positioned on the supporter. A peripheral portion of the second clipping member is positioned on a peripheral portion of the first clipping member. A gap is defined between the first and second clipping members. The electroactive pupil is positioned in the gap and contacts the first and second clipping members.

1 Claim, 7 Drawing Sheets

ARTIFICIAL EYE

BACKGROUND

1. Technical Field

The disclosure relates to an artificial eye.

2. Description of Related Art

In order to enhance playing enjoyment, various dolls or robots are provided to simulate human expressions, such as the closing and the opening of eyes. However, a typical artificial eye has a pupil that does not change with respect to different conditions. As a result, the typical artificial eye can not realistically simulate a human's eye.

Therefore, a new artificial eye is desired to overcome the above-described shortcoming.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION OF THE EMBODIMENTS

Figure 1:
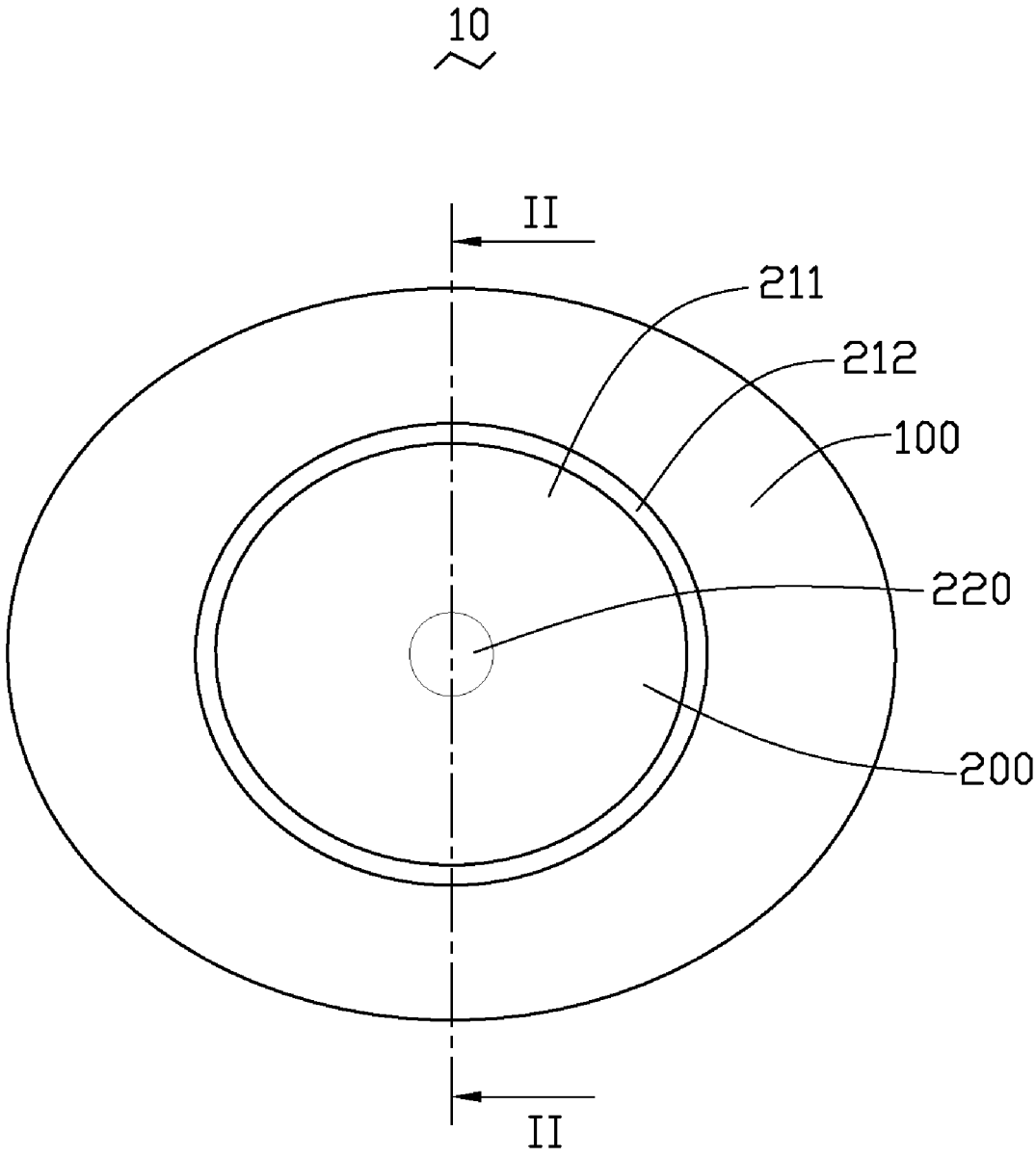
FIG. 1 is a perspective view of one embodiment of an artificial eye.
Figure 2:
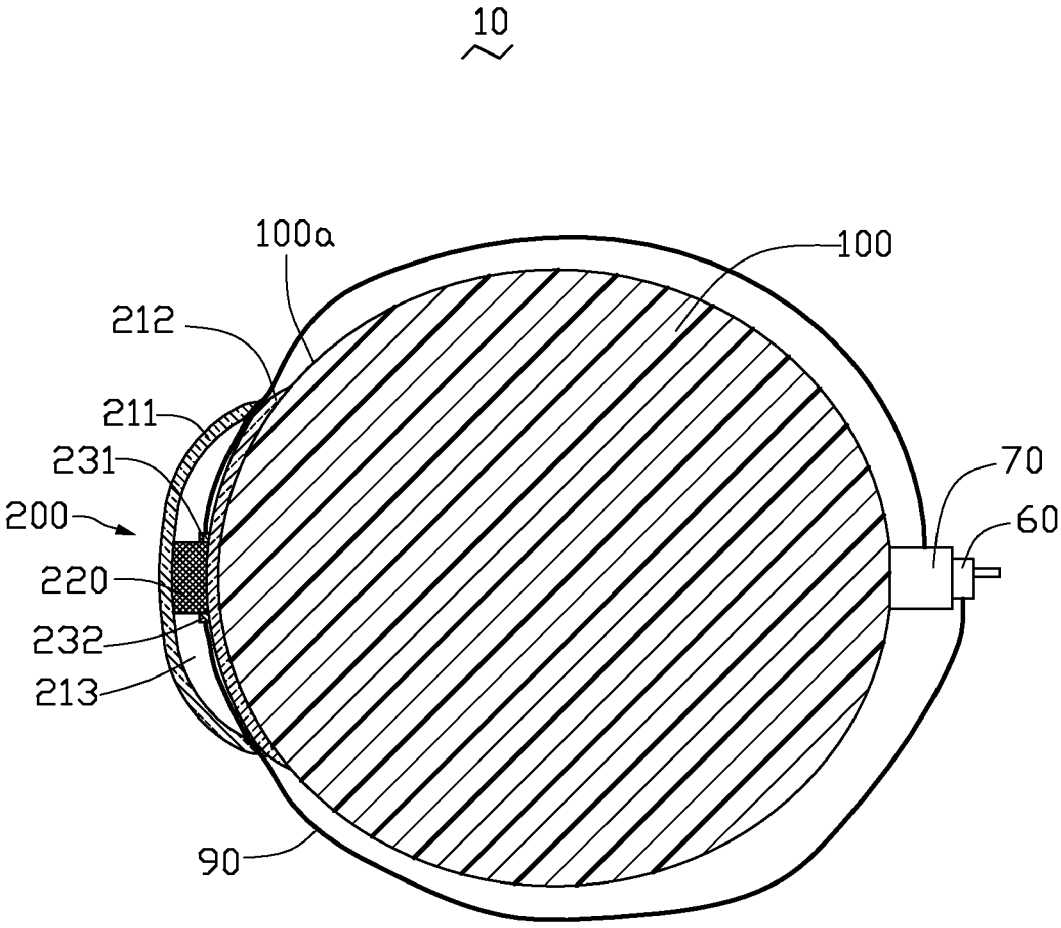
FIG. 2 is a cross-sectional view of the artificial eye of FIG. 1, taken alone line II-II.

Referring to FIGS. 1 and 2, one embodiment of an artificial eye 10 includes a supporter 100 and a pupil assembly 200 positioned on the supporter 100.

The supporter 100 may be a substantially spherical-shaped body, and made of an elastic material. The supporter 100 has a surface 100*a*.

Figure 3:
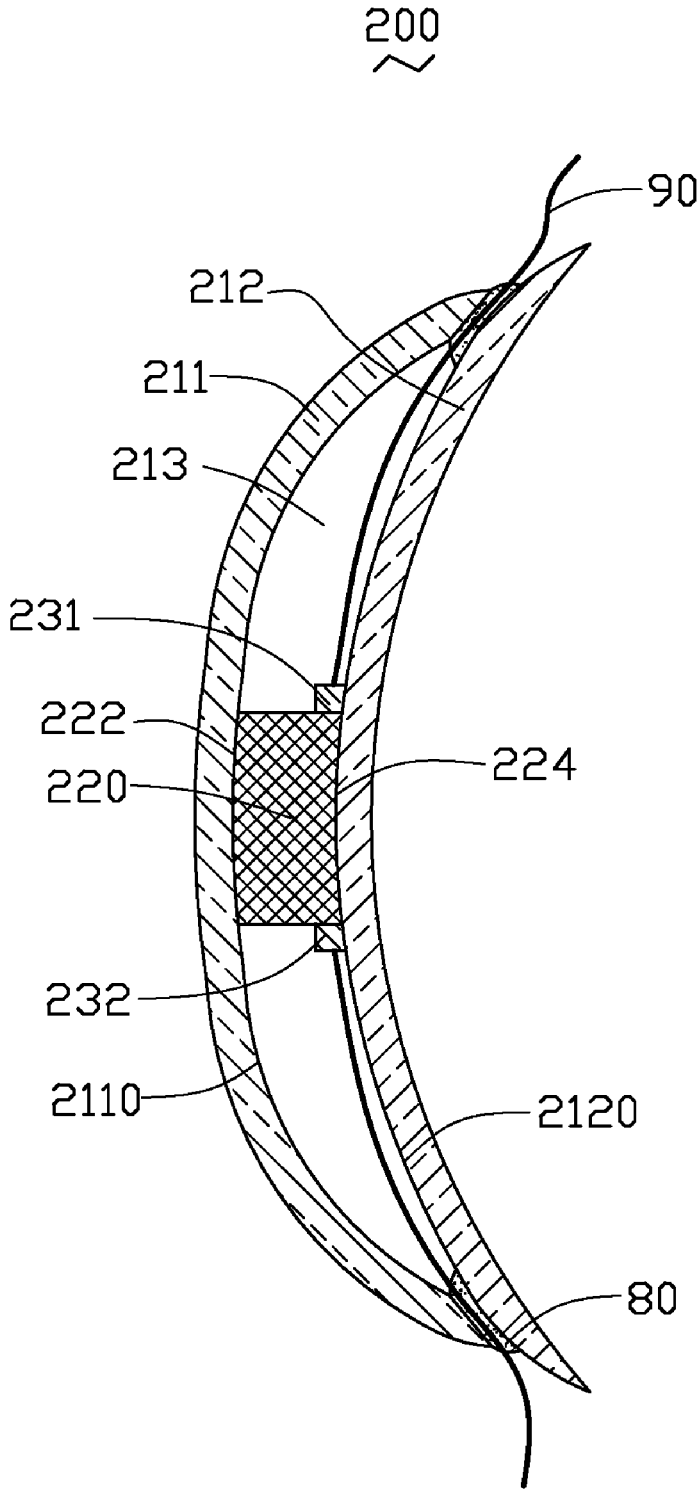
FIG. 3 is a cross-sectional view of a pupil assembly of the artificial eye of FIG. 1.

Also referring to FIG. 3, the pupil assembly 200 includes a first substantially circular-shaped clipping member 211, a second substantially circular-shaped clipping member 212, an electroactive pupil 220, a first electrode 231 and a second electrode 232. Each of the first and second clipping members 211, 212 may be a curved sheet. The first clipping member 211 has a concave surface 2110. The second clipping member 212 has a convex surface 2120. Peripheral portions of the first and second clipping members 211, 212 contact each other. In one embodiment, adhesive material members 80 are positioned between the peripheral portions to fix the first and second clipping members 211, 212 together. A gap 213 is defined between the concave surface 2110 and the convex surface 2120. The gap 213 may be a void space. The second clipping member 212 is positioned on the surface 100*a*. The first and second clipping members 211, 212 may be made of transparent materials, such as glass material, colored glass material, or polymethyl methacrylate (PMMA).

The electroactive pupil 220 is positioned in the gap 213 between the concave surface 2110 and the convex surface 2120, and made of an electroactive material, such as ion exchange membrane, gel polymer, electroactive polymer or piezoelectric polymer. The electroactive pupil 220 may be substantially cylindrical or spherical shaped. In the illustrated embodiment, the electroactive pupil 220 is substantially cylindrical shaped, has a first end 222 and a second end 224 opposite to the first end 222. The first end 222 contacts the concave surface 2110. The second end 224 contacts the convex surface 2120.

The first and second electrodes 231, 232 are positioned at two opposite ends of the electroactive pupil 220. The first electrode 231 is electrically coupled to a power source 70 via one conductive wire 90. The second electrode 232 is electrically coupled to a switch 60 via another conductive wire 90. The switch 60 is electrically coupled to the power source 70 and configured to turn on and turn off the power source 70. As a result, the electroactive pupil 220, the first and the second electrodes 231, 232, the power source 70 and the switch 60 constitute a circuit.

Figure 4:
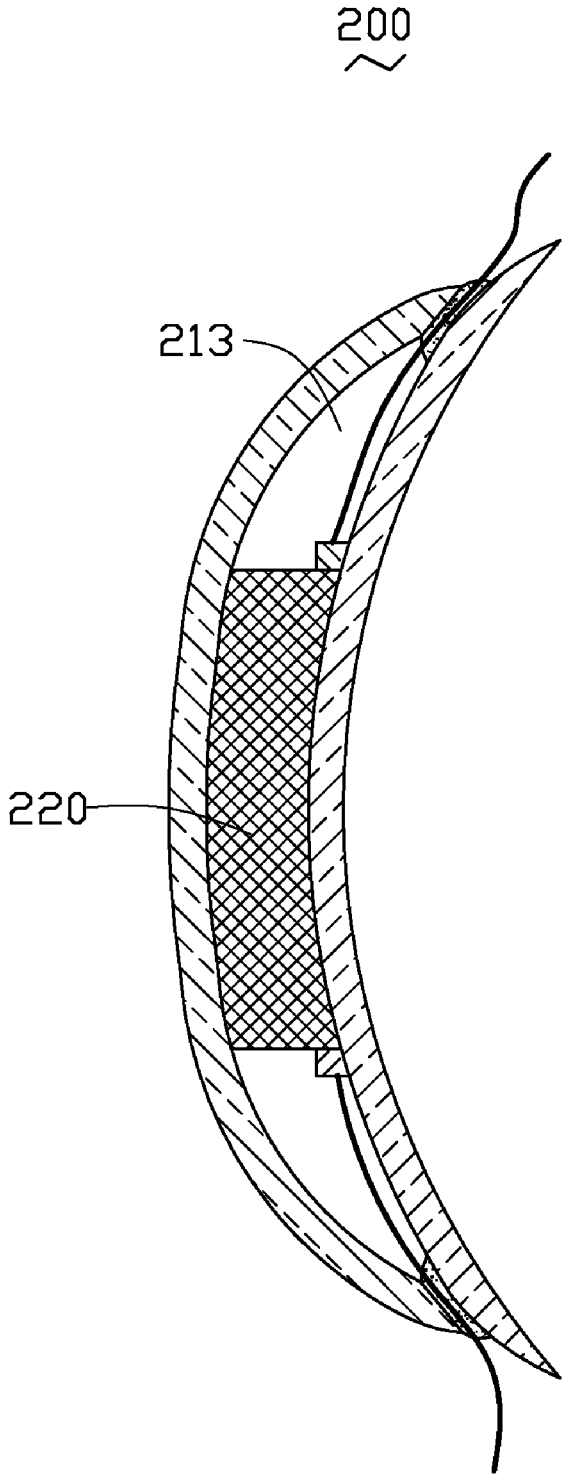
FIG. 4 is a cross-sectional view of the pupil assembly, a pupil of the pupil assembly expanding.
Figure 5:
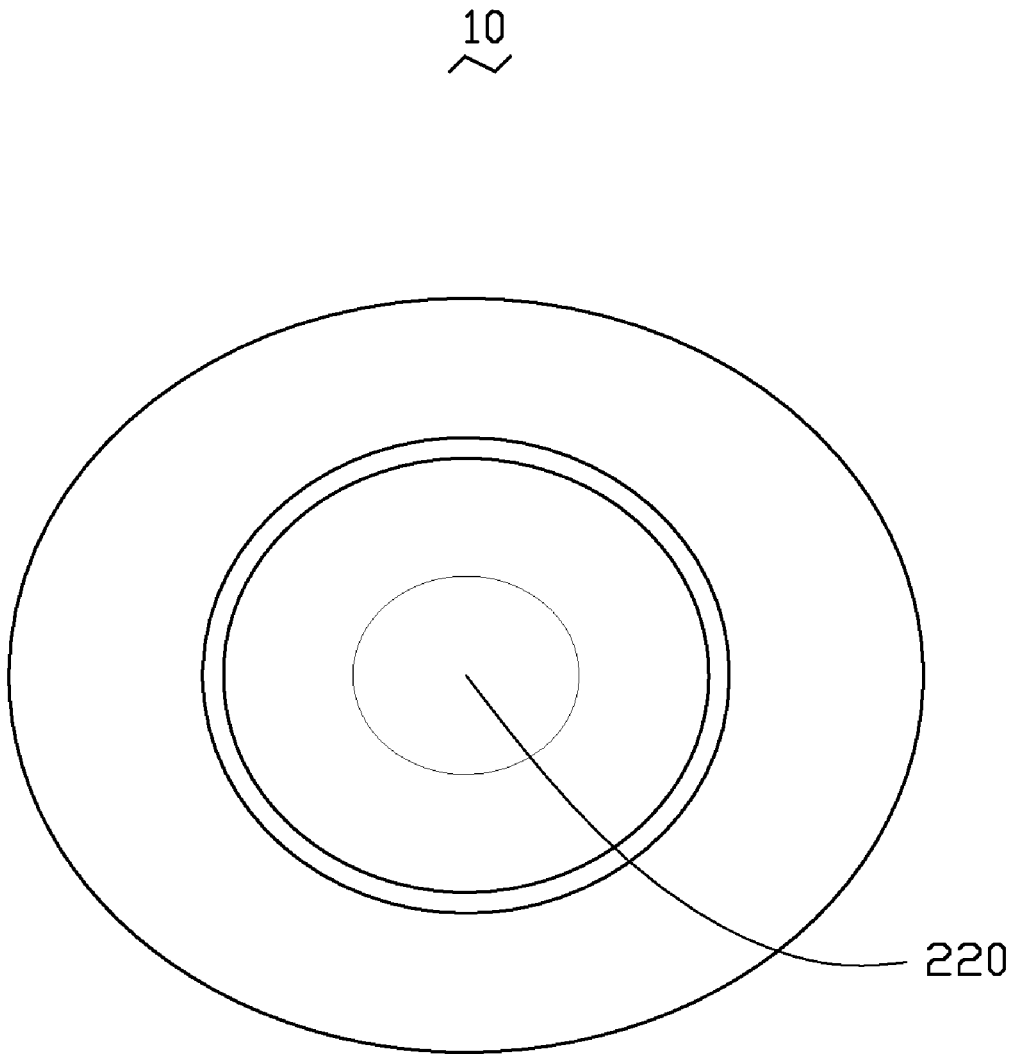
FIG. 5 is a perspective view of the artificial eye, the pupil expanding.

Also referring to FIGS. 4 and 5, in use, when the switch 60 is controlled to turn the power source 70 on, the electroactive pupil 220 is powered on to expand into the gap 213. When the switch 60 is controlled to turn the power source 70 off, the electroactive pupil 220 shrinks. Therefore, the artificial eye 10 can more realistically simulate a human eye.

Figure 6:
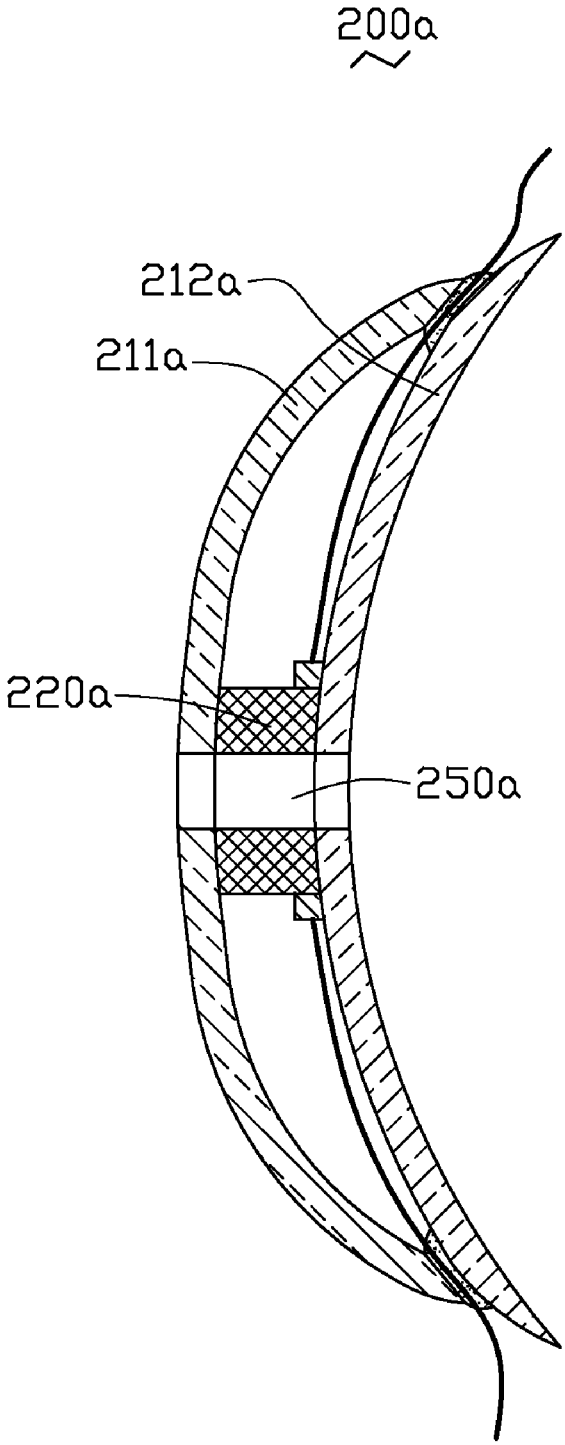
FIG. 6 is a cross-sectional view of one embodiment of a pupil assembly.

Referring to FIG. 6, another embodiment of a pupil assembly 200*a* is similar to the pupil assembly 200 of FIG. 3, except that a through hole 250*a* is defined in the first clipping member 211*a*, the pupil 220*a* and the second clipping member 212*a*. The through hole 250*a* allows a digital camera to be positioned therein.

Figure 7:
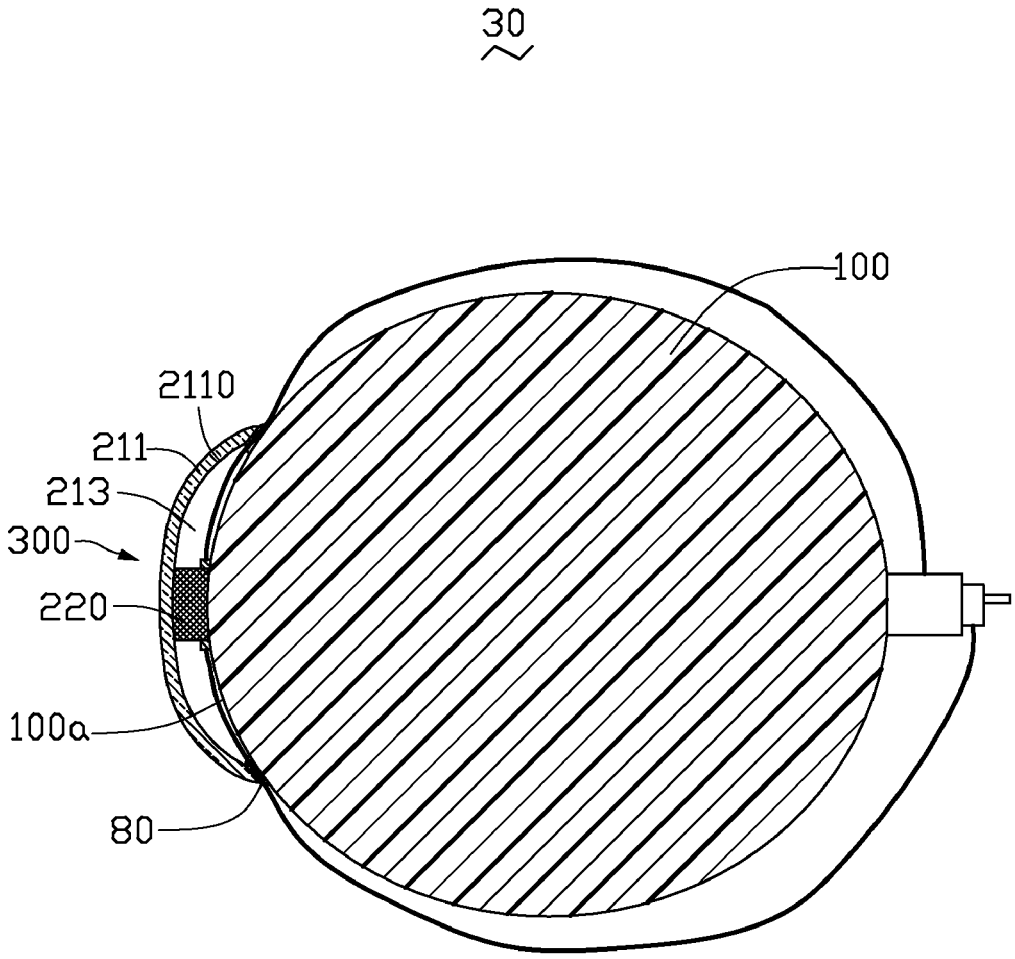
FIG. 7 is a cross-sectional view of another embodiment of an artificial eye.

Referring to FIG. 7, another embodiment of an artificial eye 30 is similar to the artificial eye 10 of FIGS. 1 through 3, except that the electroactive pupil assembly 300 includes the clipping member 211 and the electroactive pupil 220. The gap 213 is defined between the concave surface 2110 of the clipping member 211 and the surface 100*a*. The electroactive pupil 220 is positioned between the concave surface 2110 and the surface 100*a*. The adhesive material members 80 are positioned between peripheral portion of the clipping member 211 and the surface 100*a*, thereby fixing the clipping member 211 to the supporter 100.

It is believed that the present embodiments and their advantages will be understood from the foregoing description, and it will be apparent that various changes may be made thereto without departing from the spirit and scope of the embodiments or sacrificing all of its material advantages.

What is claimed is:

1. An artificial eye for a doll, comprising:

a supporter having a convex surface;

a first clipping member, the first clipping member being a curved sheet and having a concave surface;

a second clipping member having a concave surface in contact with the convex surface of the supporter, and an opposite convex surface facing toward the concave surface of the first clipping member, a gap being defined between the convex surface of the second clipping member and the concave surface of the first clipping member;

an electroactive pupil positioned in the gap, wherein a through hole is defined in the first clipping member, the electroactive pupil, and the second clipping member, and the through hole is configured for accommodating a digital camera therein;

a first electrode and a second electrode positioned on opposite ends of the electroactive pupil, the electroactive pupil being electroactively deformable toward the first and second electrodes over the convex surface of the second clipping member.

* * * * *